United States Patent [19]

Batcheller

[11] Patent Number: 4,690,383

[45] Date of Patent: Sep. 1, 1987

[54] PANEL RAIL SYSTEM

[75] Inventor: Roy W. Batcheller, West Covina, Calif.

[73] Assignee: Craneveyor Corp., South El Monte, Calif.

[21] Appl. No.: 848,244

[22] Filed: Apr. 4, 1986

[51] Int. Cl.[4] ..... E04H 17/16

[52] U.S. Cl. ..... 256/24; 256/73

[58] Field of Search ..... 256/24, 65, 73

[56] References Cited

U.S. PATENT DOCUMENTS 4,364,546 12/1982 Lyman ..... 256/73 X 4,390,165 6/1983 Murdock ..... 256/24

FOREIGN PATENT DOCUMENTS 2114816 10/1971 Fed. Rep. of Germany ..... 256/24

2338879 2/1974 Fed. Rep. of Germany ..... 256/65

1475039 2/1967 France ..... 256/65

*Primary Examiner*—Andrew V. Kundrat

*Attorney, Agent, or Firm*—Beehler, Pavitt, Siegemund, Jagger, Martella & Dawes

[57] ABSTRACT

A panel rail system which features tampered glass panels of moderate thickness makes use of supporting rails at upper and lower edges of the panels. The rails are of round, tubular cross-sectional configuration with slots for reception of edges of the panels. A modular type system is utilized wherein posts for supporting the rails can be set in advance and are of such construction that they can accommodate in the field all of the varied mounting requirements of rails and panels.

9 Claims, 7 Drawing Figures

Fig. 2.
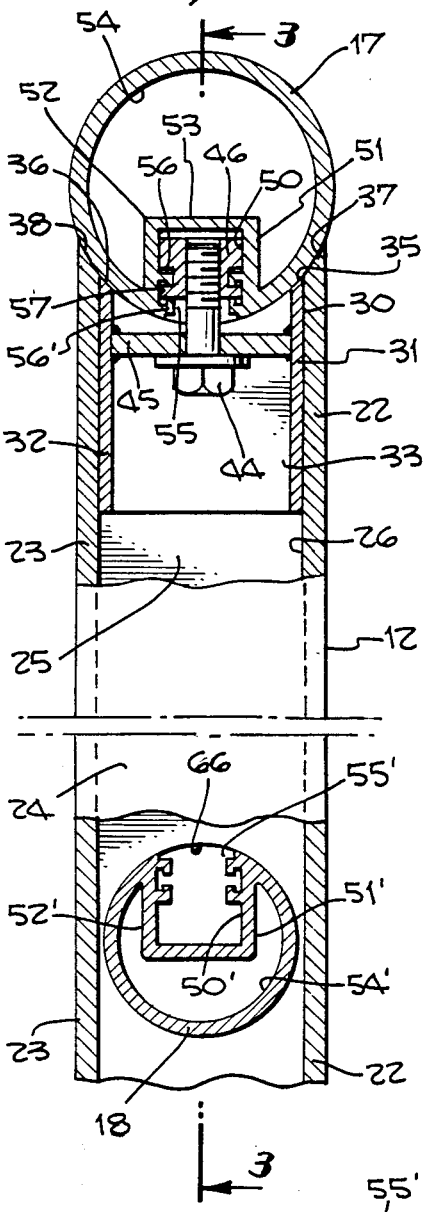
Fig. 3.
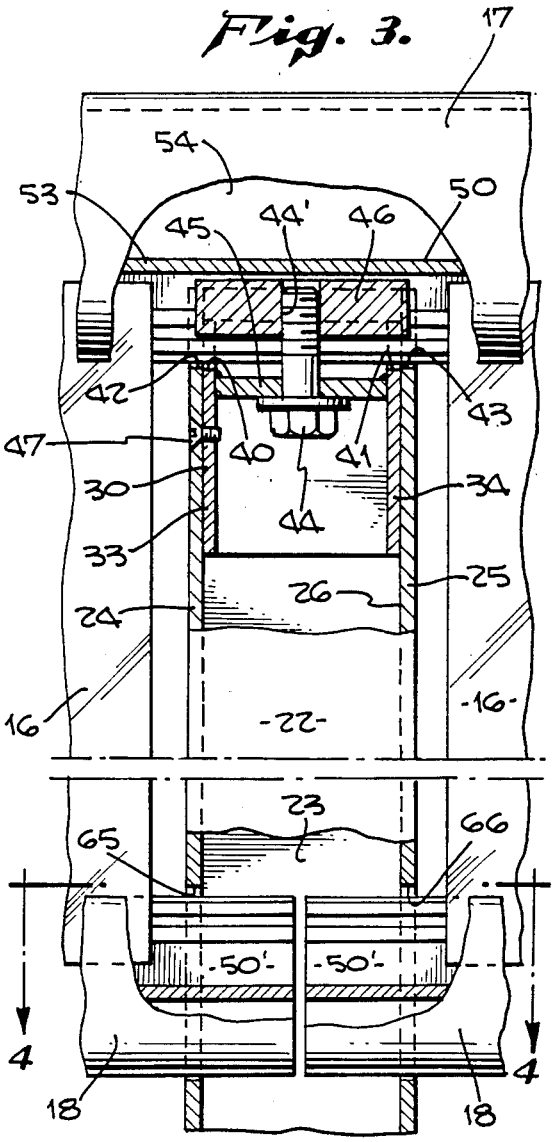
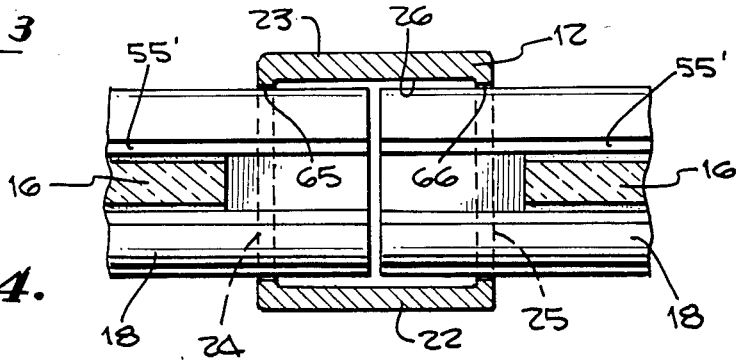
Fig. 4.

PANEL RAIL SYSTEM

Panel rail systems, and particularly those which employ glass panels, have become increasingly popular as guard rails around openings or at balcony edges to prevent people and objects of various kinds from falling over the edge. Panel rail systems differ from conventional fences in that there are no openings in the panel rail system such as would be present in a system which makes use of a wire mesh or wrought iron ribbing.

Glass panel rail systems are in popular demand because of the see-through character and also become of a distinctive eye appeal in there being a transparent wall the height of a railing. Two basic types are customarily available. One type is that featuring a structural glass rail which uses the structural properties of the glass itself, with no posts to carry horizontal loads. Glass panels ½" thick or thicker are relied on for panels of this type.

A second popular type makes use of panels of tempered glass of usually ¼" inch thickness. To be uniformly acceptable, ¼" panels are used with a structural frame, customarily of metal, to support panels of tempered glass. Most panels of the types discussed need appreciable cutting and fitting together of parts at the job location, with a corresponding expenditure of time. On occasions, panels of other appropriate material are used instead of glass.

It is therefore among the objects of the invention to provide a new and improved panel rail system, substantially all parts of which can be fitted in the field for erection.

Another object of the invention is to provide a new and improved glass panel rail system which makes use of round, tubular rails for retention of the glass panels and with supporting posts of substantially uniform construction, enabling the same posts to satisfy a variety of different installations.

Another object of the invention is to provide a new and improved glass panel rail system capable of using relatively light-weight tempered glass panels supported by upper and lower tubular rails and with post connections between the rails and posts of a character capable of effectively attaching the rails to the posts either at ends of the rails or at locations intermediate the ends of the rails.

A further object of the invention is to provide a new and improved glass panel rail system which makes use of relatively light-weight glass panels in combination with round tubular supporting rails in a manner preserving the attractive appearance which accompanies the tubular rail structure and wherein the character of the connections between the glass and rails and between the rails and supporting posts are effective in enabling both production and erection costs to be kept relatively modest.

With these and other objects in view, the invention consists of the construction, arrangement and combination of the various parts of the device serving as an example only of one or more embodiments of the invention, whereby the objects contemplated are attained as hereinafter disclosed in the specification and drawings and pointed out in the appended claims.

In the drawings:

FIG. 2 is a vertical sectional view on the line 2—2 of FIG. 1.

FIG. 3 is a vertical sectional view on the line 3—3 of FIG. 2.

FIG. 4 is a cross-sectional view on the line 4—4 of FIG. 3.

Figure 1:
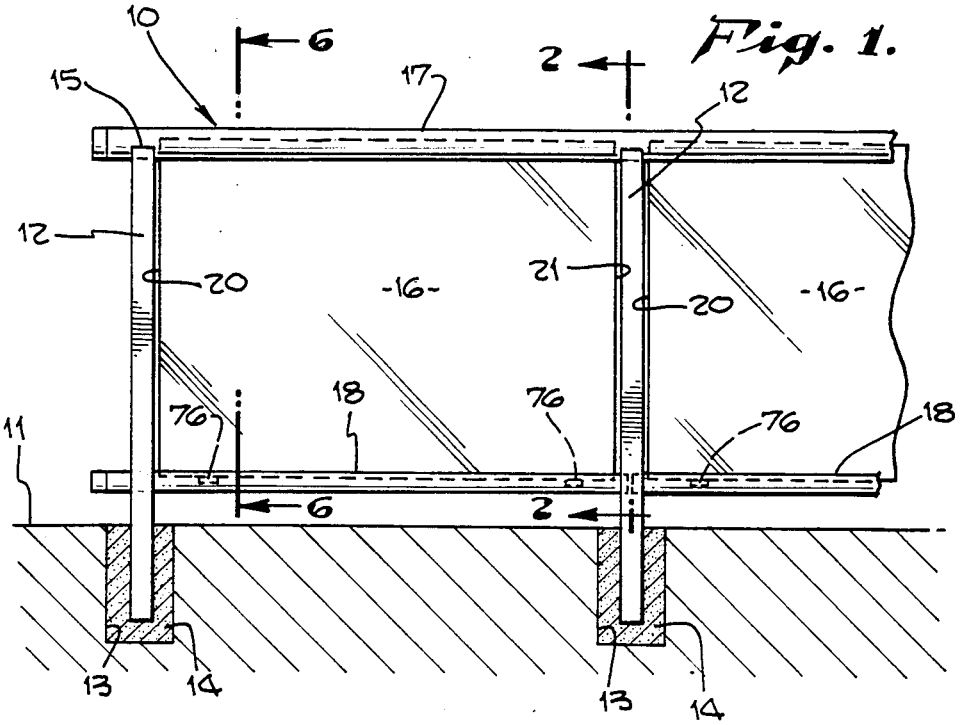
FIG. 1 is a side elevational view of a glass panel rail installation on a typical supporting surface.
Figure 6:
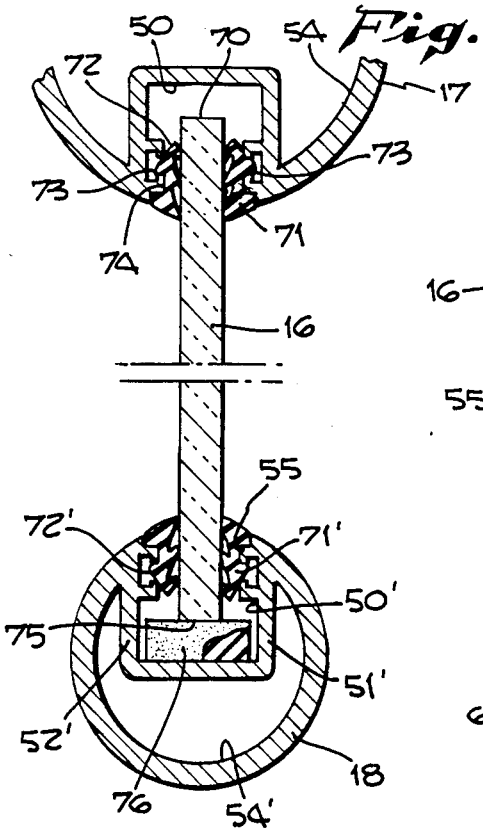
FIG. 6 is a foreshortened vertical sectional view on the line 6—6 of FIG. 1.

In one embodiment of the invention chosen for the purpose of illustration, there is shown a panel rail installation indicated generally by the reference character 10, installed on a supporting surface 11. In this installation, by way of example, posts 12 are set in post pockets 13 with the aid of an appropriate conventional grout 14. Posts may also be affixed to supporting surface by other conventional means such as by bolting to the surface or by bolting or other attachment to the side or fascia of the supporting structure. Spacing between the posts is arbitrary, depending upon needs of a particular installation and height of the top 15 of the post is about waist height of an individual or such other height as may be dictated by prevailing building codes.

Panels 16 substantially fill the area between adjacent posts. An acceptable panel is one of tempered glass of about ¼" in thickness. Glass panels of other thicknesses may be used on occasions and the system is of a character to which panels of other material may be acceptable. The panels 16 are carried and supported by an upper rail 17 at the top of the panel and a lower rail 18 at the bottom.

Although a clearance is shown between the supporting surface 11 and the lowermost part of the lower rail 18, the clearance may, if desired, be substantially eliminated or, in the alternative, may be wider. Where the general effect of a glass wall is the aim of the installation, panels may be cut so that side edges 20 and 21 of the respective panels are relatively close to the posts when the system is installed.

In the chosen embodiment of the invention the rails are tubular and preferably have a circular cross-sectional configuration. Other tubular configurations may, on occasion be preferred. Further still, in the chosen embodiment of the invention, the upper rail 17 has an outside diameter greater than the outside diameter of the lower rail 18. The same outside diameter of the upper rail 17 is equal to or greater than the transverse breadth of the post 12 between outer surfaces of the corresponding side walls 22 and 23. End walls 24, 25 in the chosen embodiment are of the same breadth as the side walls 22, 23 which results in a post which is square in cross-sectional configuration. Walls 22, 23 and 24, 25 provide a central elongated interior chamber 26. Rectangular configurations other than square may be used and also those of circular form, as in FIG. 7.

For the mounting and retention of the upper rail 17 on the top of the post 12, there is provided a sleeve 30 which, in the chosen embodiment of the invention, has a square cross-sectional exterior configuration. There is a sliding fit between the sleeve 30 and the walls of the chamber 26. The sleeve 30 has side walls 31, 32 and end walls 33, 34. Side walls 31, 32 have beveled upper edges 35, 36 which conform with the arcuate exterior of the upper rail 17. There are corresponding beveled upper edges 37, 38 for the side walls 22, 23 of the post, the bevel being blended to the arcuate shape of the top rail 17.

Arcuate recesses 40, 41 at the tops of the ends walls 33, 34 of the sleeve 30 conform to the arcuate circumference of the upper rail 17 as do also arcuate recesses 42, 43 of the end walls 24, 25 of the post 12. In this way there is provided what amounts to a saddle or nest in which the upper rail 17 rests.

For holding the rail 17 in the saddle, there is a connector, namely, a bolt 44 extending upwardly through a diaphragm 45 which is part of the sleeve 30. The bolt engages a locking bar in the form of a plug 46 which is lodged in the upper rail. A set screw 47 for anchoring the sleeve in its position is located near the top of the post.

Of special concern is provision of an elongated pocket 50 in the upper rail 17 formed by side walls 51, 52 and a bottom wall 53 which occupy a central chamber 54 in the rail. On the side of the pocket 50 opposite from the bottom wall 53 is a slotted opening 55 through which the bolt passes into engagement with the plug 46. At the insides of the side walls 51, 52 are elongated ridges 56, 56' and grooves 57. The ridges 56, 56' and grooves 57 are slidably engaged by complementary grooves 60 and ridges 61 on the side walls 58, 59 of the plug to hold the plug in engagement with the upper rail when the bolt 44 is set.

For the lower rail 18 there is a comparable central chamber 54' within which is located an elongated pocket 50' formed in part by side walls 51' and 52'.

For the rail 18 at the lower end of the post the outside diameter of the rail is less than the distance between side walls 22 and 23 of the post. Openings 65 and 66 in respective end walls 24, 25 of the post are larger in diameter than the outside diameter of the lower rail 18. Consequently, the rail can pass through the post, as shown at the left of FIG. 1, or on more frequent occasions into the post from opposite sides. The lower rail is retained in its position by its location in the hole which is bored in to the post.

In the upper rails 17 the slotted opening 55 serves a double purpose in that it receives an upper edge 70 of the panel 16. At the location of the upper edge 70 sealing strips 71, 72 are provided with ridges 73 and grooves 74 complementary with respect to the grooves 57 and ridges 56, 56' to hold the sealing strips 71, 72 in place. On occasions the strips may be replaced by caulking.

Near the lower end of the post 12 sealing strips 71', 72', similarly fashioned, serve a similar purpose in sealing against side faces of the panel 16 where a lower edge 75 extends through the slotted opening 55'. Setting blocks 76 within an elongated pocket 50' of the lower rail 18 carrying the weight of the panel 16.

Figure 7:
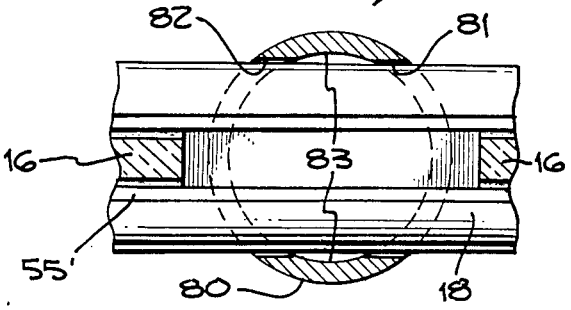
FIG. 7 is a fragmentary cross-sectional view of a modified form of post.
Figure 5:
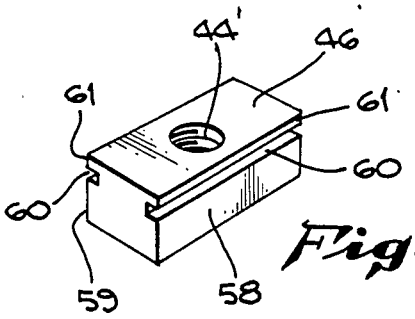
FIG. 5 is a side perspective view of one of the plugs used in the connection between rails and posts.

In the form of invention of FIG. 7, there is depicted a round post 80 in section at the location of the lower rail 18. The post is provided with aligned openings 81 and 82 on opposite sides of diameter sufficient to accommodate the rail 18. Should the spacing of the posts so dictate sections of the rail 18 can be projected from opposite sides of the post through the respective holes 81 and 82 to positions of near abutment within chamber 83 of the post similar to the arrangement of FIG. 4. The top of the round post would be formed with arcuate recesses similar to those described for the square post for reception of the upper rail 17 and retention by sleeves of the general construction heretofore disclosed.

The cost effective use of the system disclosed is such that only the posts need to be fabricated as, for example, by shop work. Fabrication to manufacture posts consists of cutting tubular material to length to form the post 12, machining the saddle at the top end of the post, as by contouring upper edges 37, 38 for the side walls 22, 23 of the post, and boring a hole 65, 66 through the lower portion of the post to allow passage of the lower rail 18. The top rail 17 and lower rail 18 require no shop fabrication.

The manufactured post 12 may be painted or otherwise finished (anodized in the case of aluminum posts) as a manufactured part. The top and lower rails 17, 18 are customarily painted or otherwise finished in stock lengths as they are extruded.

In employment of the system, posts, (whether they may be end, corner or in-line posts) are located and loosely positioned on the supporting surface 11. Lower rails 18 are then cut to length as required to go between posts with ends projecting approximately half way into the posts. Good practice suggests that the length of the lower rail equal the distance between center lines of adjacent posts less approximately $\frac{5}{8}$ inch.

Unspliced lengths of the lower rail can project through one or more posts on some installations which allow for assembly. The fit of lower rails 18 within the holes 65, 66 in post 12 holds lower rails 18 in place.

Plugs 46 are slid into the open end of the pocket 50 in top rail 17, one plug for each post which the top rail 17 will span. Sleeves 30 are positioned on the outside of top rail 17 at the location of the plugs 46 and locking bolts 44 are screwed into a corresponding threaded hole 44' of plug 46 but not tightened. With the sleeves 30 attached loosely to plugs 46, they are then slide along the top rail 17 until they are located exactly in proper position to slip into the top end of the corresponding post 12. When this proper position is determined, the locking bolt 44 is tightened to lock sleeve 30 to the top rail 17 by means of the clamping action of the plug 46. When the sleeves 30 have been locked into position, the top rail 17 is pulled down tightly so that the top rail 17 fits snug into the saddles 37, 38 of the posts. When the top rail is in proper position as noted above, a set screw 47 is screwed through one or both sides 24, 25 of the post and into the sleeve 30 to lock the sleeve and thus the rail 17 to the post. The screws 47 are in line with and adjacent to the place where edges 20, 21 of panel 16 will be located, so that screws 47 cannot be removed after the panels are in place.

The next step in the installation of the system is to align the metal frame that has been constructed as noted above by plumbing posts and setting rails 17 and 18 in line with supporting structure. In FIG. 1 of the illustration, the posts 12 are grouted into post pockets 13 with conventional grout 14. Posts could be affixed by a number of other conventional means.

The resulting metal structural frame consisting of posts 12 and rails 17 and 18 is one which has been quickly constructed using simple and conventional tools in the field, namely, at the job site, from pre-fabricated posts 12 and stock lengths of rails 17 and 18.

Measurements are taken to determine the length of the required panels 16. Panels may be tempered glass, plastic, or other clear, translucent or opaque material, usually $\frac{1}{4}''$ thick. The vertical dimension of panel 16 is made so that when the top edge 70 of the panel is inserted through the slotted opening 55 into the pocket 50 of the top rail 17 as far as possible, the lower edge 75 of the panel 16 will clear the upper outside surface of the lower rail 18. The horizontal dimension of panel 16 is usually one-half inch less than the clear dimension between posts 12.

The panel 16 is installed in a completed metal frame by first placing setting blocks 76, usually made of rubber, in the open end of the pocket 50' of lower rail 18. The lower rail 18 is rotated so that the slotted opening 55' is in a vertical position. The panel 16 is lifted to insert the upper edge 70 into pocket 50 of top rail 17 as far as possible. Then while held in the fully inserted position, the lower edge 75 of panel 16 is moved inward so that the edge 75 is over the slotted opening 55' of the pocket 50'. The panel is allowed to lower into pocket 50' in the lower rail until it comes to rest on top of setting blocks 76. In this position, edges 70 and 75 of panel 16 extend equal into pockets 50, 50', respectively, of top rail 17 and lower rail 18, and are thus retained. Strips 71, 72 and 71', 72' are then pushed into place to fix the mounting of the panel. Caulking with conventional glazing compounds may be used instead of the strips. Panels can be removed and/or replaced by a reverse of the process described, namely, by removal of strips or caulking, then lifting the panel up and out.

While a particular embodiment of the present invention has been shown and described, alternative structures are suggested and it will be obvious to those skilled in the art that changes and modifications may be made without departing from the invention in its broader aspects and therefore the aim of its appended claims is to cover all such changes and modifications as fall within the true spirit and scope of the invention.

Having described the invention, what is claimed as new in support of Letters Patent is as follows:

1. A panel rail system comprising posts adapted to be set at locations in an appropriate surface structure, unitary panels having each an upper edge and a lower edge for substantially spanning the area between adjacent posts, an upper rail having a longitudinal slotted junction for reception of the upper edge of the panel, a lower rail having a longitudinal slotted junction for reception of the lower edge of the panel, said posts having an upper and lower retention means for supporting retention of the rails, the upper retention means having a rail-engaging means for reception of the upper rail, the lower retention means having a rail-engaging means for reception of the lower rail, and a connector adapted to interconnect said respective rail-engaging means and the corresponding rail, each post having a chamber throughout its length and said retention means comprising a sleeve with a sliding fit within the chamber.

2. A panel rail system as in claim 1 wherein the retention means between the upper rail and the corresponding sleeve is at a location intermediate ends of the rail.

3. A panel rail system comprising posts adapted to be set at locations in an appropriate surface structure, unitary panels having each an upper edge and a lower edge for substantially spanning the area between adjacent posts, an upper rail having a longitudinal slotted junction for reception of the upper edge of the panel, a lower rail having a longitudinal slotted junction for reception of the lower edge of the panel, said posts having an upper and lower retention means for supporting retention of the rails, the upper retention means having a rail-engaging means for reception of the upper rail, the lower retention means having a rail-engaging means for reception of the lower rail, and a connector adapted to interconnect said respective rail-engaging means and the corresponding rail, each post having a chamber throughout its length and retention means comprising a sleeve with a sliding fit within the chamber, a bolt-holding element within the sleeve and a bolt for said bolt-holding element adapted to interconnect the sleeve and the rail.

4. A panel rail system comprising posts adapted to be set at locations in an appropriate surface structure, unitary panels each having side edges adjacent to and free of engagement with said posts, an upper edge and a lower edge for substantially spanning the area between the adjacent posts, an upper rail having a downwardly facing longitudinal slotted junction for reception of the upper edge of the panel, a lower rail having an upwardly facing longitudinal slotted junction for reception of the lower edge of the panel, said posts having upper and lower retention means for supporting retention of the rails, the upper retention means having a rail-engaging means for reception of the upper rail, the lower retention means having a rail-engaging means for reception of the lower rail, and a connector adapted to interconnect said respective rail-engaging means and the corresponding rail, said slotted junctions each comprising interior walls within the rail forming an elongated pocket with an opening at the side in alignment with the slotted junction for reception of the corresponding edge of a panel, said interior walls including longitudinally extending groove elements, plugs having groove elements complementary with respect to the groove elements of the interior walls receptive of said last identified groove elements, there being a sleeve in the post for reception of a corresponding rail and a bolt connection between said plug and said sleeve.

5. A panel rail system comprising posts adapted to be set at locations in an appropriate surface structure, unitary panels each having side edges adjacent to and free of engagement with said posts, an upper edge and a lower edge for substantially spanning the area between the adjacent posts, an upper rail having a downwardly facing longitudinal slotted junction for reception of the upper edge of the panel, a lower rail having an upwardly facing longitudinal slotted junction for reception of the lower edge of the panel, said posts having upper and lower retention means for supporting retention of the rails, the upper retention means having a rail-engaging means for reception of the upper rail, the lower retention means having a rail-engaging means for reception of the lower rail, and a connector adapted to interconnect said respective rail-engaging means and the corresponding rail, said slotted junctions each comprising interior walls within the rail forming an elongated pocket with an opening at the side in alignment with the slotted junction for reception of the corresponding edge of a panel, said interior walls including longitudinally extending groove elements, plugs having groove elements complementary with respect to the groove elements of the interior walls receptive of said last identified groove elements, there being a sleeve in the post for reception of a corresponding rail and a bolt connection between said plug and said sleeve, said plug having a longitudinally sliding engagement with the corresponding rail.

6. A panel rail system comprising posts adapted to be set at locations in an appropriate surface structure, unitary panels each having side edges adjacent to and free of engagement with said posts, an upper edge and a lower edge for substantially spanning the area between the adjacent posts, an upper rail having a downwardly facing longitudinal slotted junction for reception of the upper edge of the panel, a lower rail having an upwardly facing longitudinal slotted junction for reception of the lower edge of the panel, said posts having upper and lower retention means for supporting retention of the rails, the upper retention means having a rail-engaging means for reception of the upper rail, the lower retention means having a rail-engaging means for reception of the lower rail, and a connector adapted to interconnect said respective rail-engaging means and the corresponding rail, the slotted junctions in respectively the upper and lower rails each providing a space for reception of the upper and lower edge portions of the panel, the space provided by the slotted junction of the upper rail having a depth in excess of the depth of the space provided by the slotted junction of the lower rail whereby the lower edge of the panel is clear of the lower rail when the upper edge of the panel is within the upper rail to enable mounting of said panel in position and extraction of said panel from position spanning said area while said rails remain in place on said posts.

7. A method for constructing and erecting a panel rail system from panels, hollow posts, hollow upper and lower rails and connecting members comprising the steps of forming a transverse arcuate recess at the top end of the posts corresponding to the exterior form of the upper rail, forming a transverse hole through the lower end of the posts corresponding to the exterior size of the lower rail for reception of the lower rail, forming a connecting sleeve to fit the interior of the upper end of each of the posts, forming a longitudinally extending slot in both said rails communicating between the exterior and the hollow interior, forming connecting plugs with a sliding fit for the interior of said upper rail, connecting said sleeves with corresponding plugs and securing said sleeves in the tops of said posts and mounting said posts on a supporting surface, mounting said lower rail in the holes of said posts, projecting the upper edge of the panel through the slot into the hollow interior of the upper rail and then lowering the lower edge of the panel through the slot into the hollow interior of the lower rail.

8. The method for constructing and erecting a panel rail system as in claim 7 including preparing and positioning pads in the hollow interior of the lower rail for support of said panel.

9. The method for constructing and erecting a panel rail system as in claim 7 including forming seals between the surfaces of the panel and opposite sides of the slots in said rails.

* * * * *